United States Patent [19]

Smith et al.

[11] 4,169,971

[45] Oct. 2, 1979

[54] ELECTRICAL SWITCH CONSTRUCTION

[75] Inventors: William N. Smith; Frank Payne, both of Knoxville, Tenn.

[73] Assignee: Robertshaw Controls Company, Richmond, Va.

[21] Appl. No.: 880,202

[22] Filed: Feb. 22, 1978

[51] Int. Cl.[2] ..... H01H 13/26; H01H 13/52

[52] U.S. Cl. ..... 200/67 B; 200/67 D

[58] Field of Search ..... 200/67 B, 67 D, 67 DA, 200/68, 73, 67 R

[56] References Cited

U.S. PATENT DOCUMENTS

| | | | |
|---|---|---|---|
| 2,387,089 | 10/1945 | Peterson et al. | 200/67 D |
| 2,505,605 | 4/1950 | Coake | 200/67 D |
| 3,073,923 | 1/1963 | Anderson et al. | 200/67 B |
| 3,242,281 | 3/1966 | Brevick et al. | 200/67 B |
| 3,319,022 | 5/1967 | Froyd et al. | 200/67 D |
| 3,485,975 | 12/1969 | Long | 200/67 B |
| 3,967,086 | 6/1976 | Bauer | 200/328 |

FOREIGN PATENT DOCUMENTS

| | | | |
|---|---|---|---|
| 1344484 | 10/1962 | France | 200/67 B |

*Primary Examiner*—Richard E. Aegerter
*Assistant Examiner*—John W. Shepperd
*Attorney, Agent, or Firm*—Candor, Candor & Tassone

[57] ABSTRACT

An electrical switch construction having a housing carrying a pair of spaced contact stops and a snap switch blade having a contact portion for being snapped between the stops when the blade is moved over center by an actuator spring member that is movable relative to the housing by an actuator plunger. The actuator spring member has opposed ends respectively and operatively interconnected to the housing and to the blade and being under tension between the ends thereof so as to have a resultant spring force normally tending to move the actuator spring member toward the plunger and thereby the switch blade toward one of the contact stops. The actuator spring member comprises a one-piece substantially L-shaped leaf spring member separate from the blade and having two legs respectively defining the opposed ends thereof, one of the legs being pivotally mounted to the housing to operatively interconnect that one leg to the housing.

7 Claims, 7 Drawing Figures

ELECTRICAL SWITCH CONSTRUCTION

BACKGROUND OF THE INVENTION

1. Field of the Invention

This invention relates to an improved electrical switch construction and to a method of making the same.

2. Prior Art Statement

It is known to applicants to provide an electrical switch construction having a housing carrying a pair of spaced contact stops and a snap switch blade having a contact portion for being snapped between the stops when the blade is moved over center by an actuator spring member or operating lever that is operatively interconnected to the blade and is movable relative to the housing by an actuator plunger.

For example, see:

(1) U.S. Pat. No. 4,109,121—Bauer et al.
(2) U.S. Pat. No. 3,967,086—Bauer.
(3) U.S. Pat. No. 3,242,281—Brevick, et al.
(4) U.S. Pat. No. 3,485,975—Long.

The actuator spring member of the electrical switch construction of item (1) above is placed under compression between its opposed ends whereas the operating lever of item (2) above is not a spring member but has a separate spring member that is under compression between the operating lever and a toggle member that operates the main snap switch blade, the electrical switch constructions of items (1) and (2) above each sustaining a contact force of the main switch blade against its stop until the actuator spring member or operating lever snaps over center to cause the snap switch blade itself to be, in effect, snapped over center. The actuator spring member of items (3) and (4) above each comprises an elongated coiled tension spring.

SUMMARY OF THE INVENTION

It is a feature of this invention to provide an electrical switch construction with an improved actuator spring member.

In particular, one embodiment of this invention provides an electrical switch construction having a housing means carrying a pair of spaced contact stops and a snap switch blade having a contact portion for being snapped between the stops when the blade is moved over center by an actuator spring member that is movable relative to the housing means by an actuator plunger. The actuator spring member has opposed ends respectively and operatively interconnected to the housing means and to the blade and being under tension between the ends thereof so as to have a resultant spring force normally tending to move the actuator member toward the plunger and thereby the blade toward one of the contact stops. The actuator spring member comprises a one-piece substantially L-shaped leaf spring member separate from the blade and having two legs that respectively define the opposed ends thereof, one of the legs being pivotally mounted to the housing means to operatively interconnect that one leg to the housing means.

In one embodiment of the electrical switch construction of this invention, the other leg of the actuator spring member is interconnected directly to a tongue of the switch blade whereas in another embodiment of the electrical switch construction of this invention, the other leg of the actuator spring is interconnected to the switch blade by a toggle part.

Accordingly, it is an object of this invention to provide an improved electrical switch construction having one or more of the novel features of this invention as set forth above or hereinafter shown or described.

Another object of this invention is to provide a method of making such an electrical switch construction or the like, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
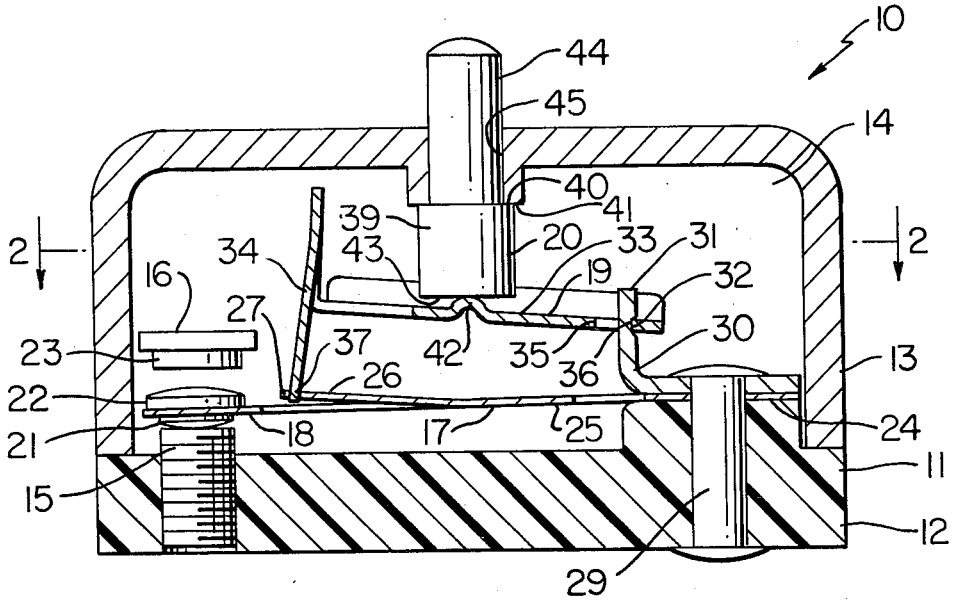
FIG. 1 is a cross-sectional view of an improved electrical switch construction of this invention, FIG. 1 being taken on line 1—1 of FIG. 2.

While the various features of this invention are hereinafter described and illustrated as being particularly adapted to provide a miniature switch to be used in controls where extremely tight tolerances must be held with the switch having a high degree of repeatability, it is to be understood that the various features of this invention can be utilized singly or in any combination thereof to provide an electrical switch construction for other uses as desired.

Therefore, this invention is not to be limited to only the embodiments illustrated in the drawing because the drawings are merely utilized to illustrate one of the wide variety of uses of this invention.

Figure 2:
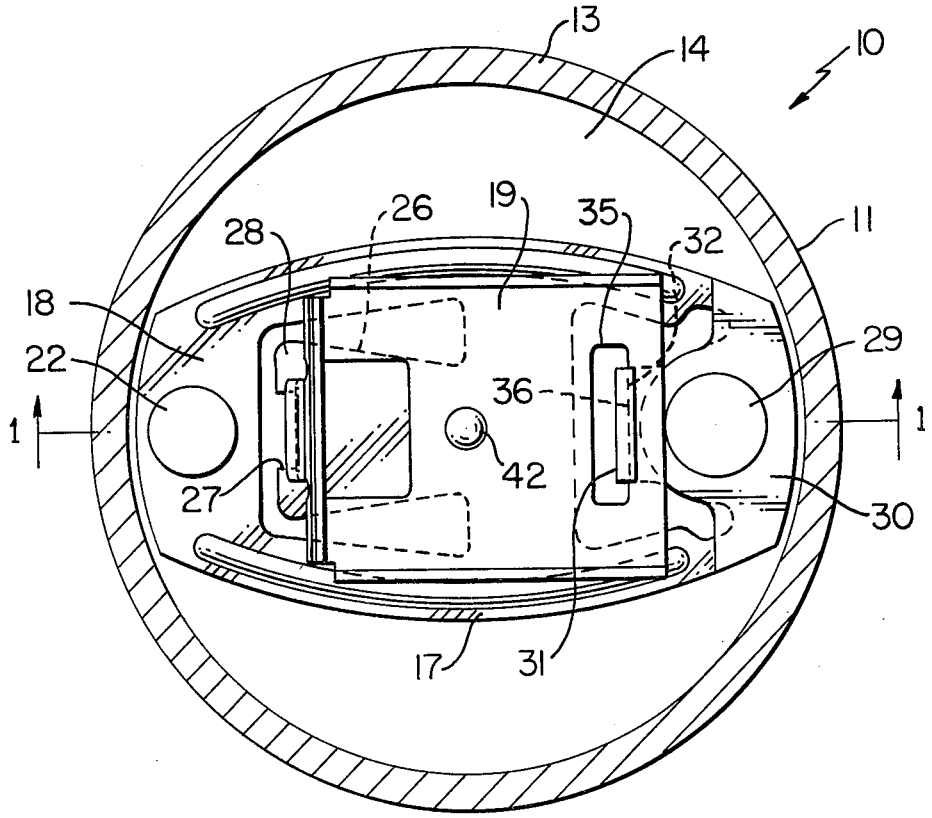
FIG. 2 is a cross-sectional view taken on line 2—2 of FIG. 1.
Figure 3:
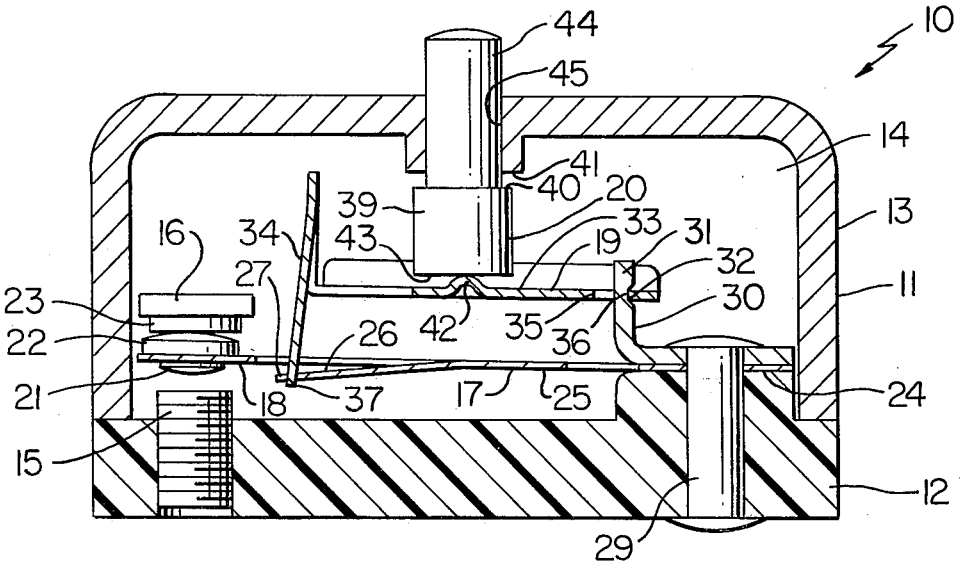
FIG. 3 is a view similar to FIG. 1 and illustrates the electrical switch construction in another operating condition thereof.

Referring now to FIGS. 1–3, one embodiment of the electrical switch construction of this invention is generally indicated by the reference numeral 10 and comprises a housing means 11 formed of two parts 12 and 13 suitably secured together in any suitable manner to define a chamber 14 therein.

The housing means 11 carries a pair of spaced contact stops 15 and 16 and a snap switch blade 17 having a contact portion 18 for moving between the contact stops 15 and 16 when the blade 17 is moved over center by an actuator spring member 19 that is operatively interconnected to the blade 17 and is movable relative to the housing means 11 by an actuator plunger 20 also movably carried by the housing means 11.

The contact stop 15 can be made adjustable relative to the housing means 11 through a threaded relation as illustrated and the contact portion 18 of the snap blade 17 can have opposed contact means 21 and 22 thereon as illustrated so that the contact means 21 will cooperate with the contact stop 15 and the contact means 22 can cooperate with a contact means 23 of the contact stop 16 in the manner illustrated in FIG. 3.

Figure 4:
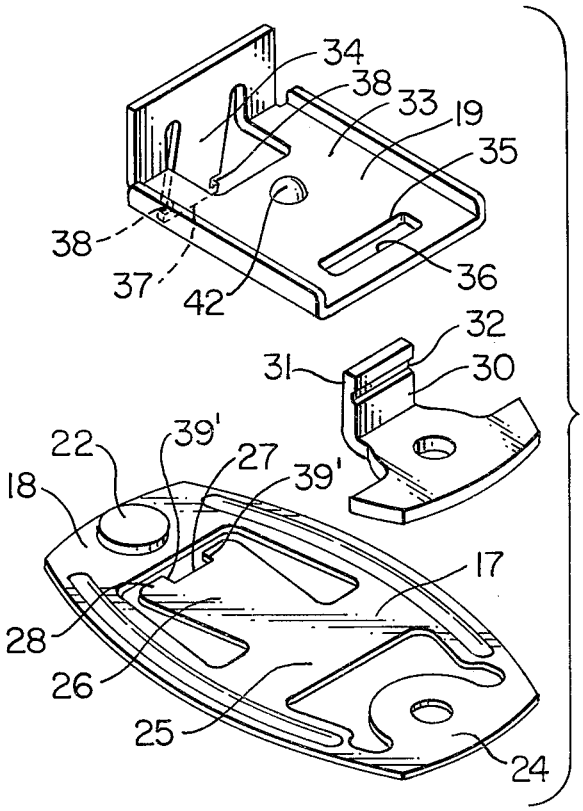
FIG. 4 is an exploded perspective view of the actuator spring member and snap switch blade of the electrical switch construction of FIGS. 1–3.

As illustrated in FIG. 4, the snap blade 17 has the contact portion 18 thereof disposed at one end of the blade 17 and a fastening portion 24 disposed at the other end thereof with an intermediate area 25 of the blade 17 being provided with a tongue 26 having a notch 27 in the free end 28 thereof as illustrated.

The fastening end 24 of the snap blade 17 is fastened to the housing means 11 by a fastening member 29 that also fastens an L-shaped bracket or arm 30 to the housing means 11, the L-shaped bracket 30 having an upstanding arm 31 provided with a notch 32 to pivotally mount the actuator spring member 19 to the housing means 11.

In particular, the actuator spring member 19 is substantially L-shaped and thereby defines a pair of legs 33 and 34 in the manner illustrated in FIG. 4 with the leg 33 having a slot 35 passing therethrough to telescopically receive the leg 31 of the L-shaped bracket 30 therethrough so that an edge 36 of the actuator spring 19 can be received in the notch 32 to pivotally mount the actuator spring member 19 to the housing means 11 on the plunger side of the blade 17 and in a manner spaced above the blade 17 as illustrated in FIG. 1 for a purpose hereinafter described.

The other leg 34 of the actuator spring member 19 has its free end 37 provided with a pair of side notches 38 which are adapted to respectively receive the facing edges 39' of the end 28 of the tongue 26 when the free end 37 of the leg 34 of the actuator spring member 19 is received in the notch 27 of the tongue 26 to interconnect the actuator spring member 19 to the tongue 26 of the blade 17 and, thus, to the blade 17.

The L-shaped actuator spring member 19 is initially formed so that the leg 34 must be forced outwardly to interconnect the same to the tongue 26 after the leg 33 is interconnected to the L-shaped bracket 30 so that the actuator spring member 19 is placed under tension between the L-shaped bracket 30 and the tongue 26 of the snap blade 17 whereby a resultant spring force is provided by the tensioned actuator spring member 19 to tend to always move the actuator member 19 in a clockwise direction about the pivot arm 30 in FIG. 1 and, thus, in a direction towards the actuator plunger 20 to pull the tongue 26 over centers as illustrated in FIG. 1 and thereby force the contact portion 18 of the spring blade 17 in its snapped condition against the fixed stop 15.

The actuator plunger 20 has an enlarged end portion 39 disposed in the chamber 14 of the housing means 11 so that a shoulder 40 thereof will abut against a surface 41 of the housing means 11 in the manner illustrated in FIG. 1 to prevent further upward movement of the actuator spring member 19 as the same has an abutment 42 thereof bearing against the lower surface 43 of the actuator plunger 20 as illustrated. In this manner, the upper reduced portion 44 of the plunger 20 can project out through an opening 45 of the housing means 11 to permit the switch construction 10 to be manually or mechanically operated in a manner now to be described.

As previously stated, the resultant spring force produced by the actuator spring member 19 being constantly under tension tends to pivot the actuator spring member 19 in a clockwise direction in FIG. 1 so that the electrical switch construction 10 is normally in the condition illustrated in FIG. 1 wherein the snap switch blade 17 is electrically interconnected to the contact stop 15 and is out of electrical contact with the contact stop 16.

When a force is imposed downwardly on the plunger end 44 of the actuator plunger 20 to overcome the normal clockwise rotational spring force of the actuator spring member 19, the actuator spring member 19 is moved in a counterclockwise direction in FIG. 1 to move the tongue end 28 downwardly in FIG. 1 until the tongue end 28 moves over center relative to the snap blade 17 whereby the stored energy in the tensioned actuator spring member 19 then acts upwardly on the switch blade 17 to cause the switch blade 17 to snap over center and move its contact portion 18 rapidly upwardly to place the contact means 22 thereof into electrical contact with the contact stop 16 as illustrated in FIG. 3 and remain in such condition as long as the plunger 20 is held inwardly in the manner illustrated in FIG. 3.

However, upon removal of the downward force on the plunger 20, the tensioned force of the actuator spring member 19 will again move the actuator spring member 19 in a clockwise direction in FIG. 3 to move the plunger upwardly and thereby move the tongue end 28 upwardly therewith until the tongue end 28 moves over center relative to the switch blade 17 and thereby cause the switch blade 17 to snap its contact portion 18 downwardly through the stored spring energy of the actuator spring member 19 to again place the contact portion 18 of the snap blade 17 into contact with the contact stop 15 as illustrated in FIG. 1.

Figure 5:
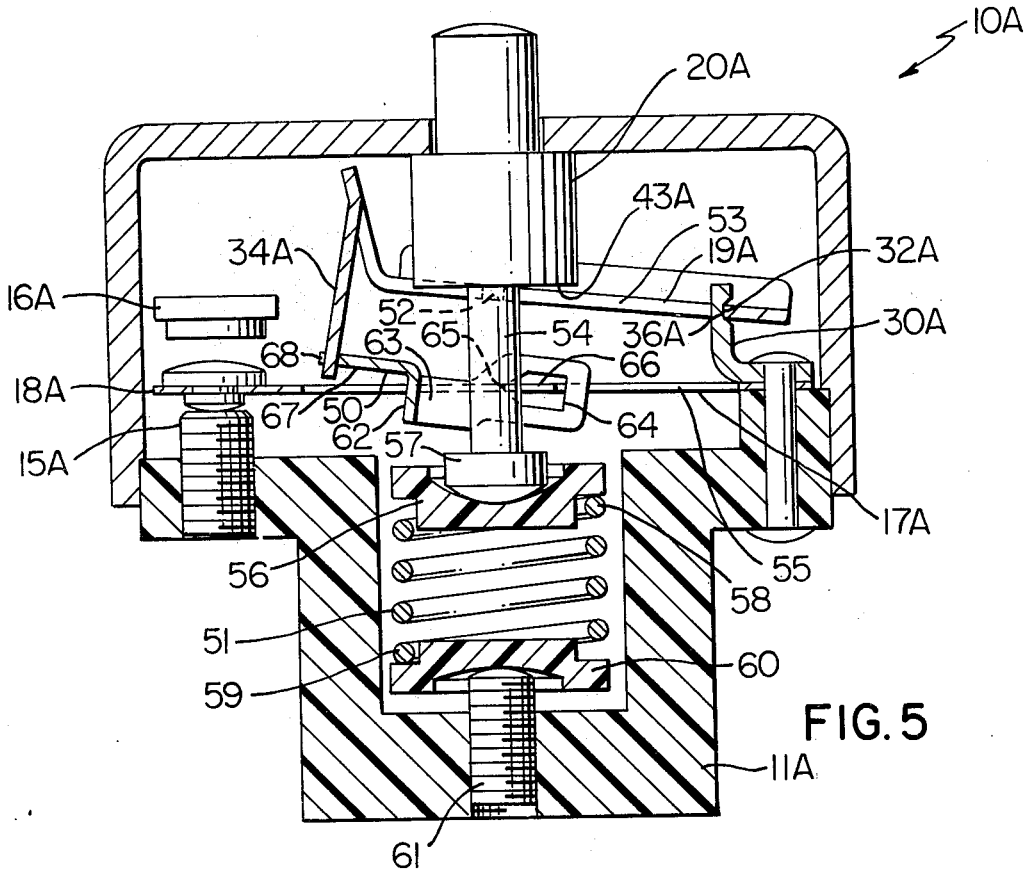
FIG. 5 is a view similar to FIG. 1 and illustrates another electrical switch construction of this invention.

Another electrical switch construction of this invention is generally indicated by the reference number 10A in FIG. 5 and parts thereof similar to the switch construction 10 previously described are indicated by like reference numerals followed by the reference letter "A".

As illustrated in FIG. 5, the electrical switch construction 10A of this invention is substantially the same as the switch construction 10 previously described except that the electrical switch construction 10A includes a toggle part 50 that operatively interconnects the leg 34A of the actuator spring member 19A to the snap switch blade 17A in a manner hereinafter described and an additional return spring 51 that operates on the actuator plunger 20A in a manner hereinafter described.

Figure 6:
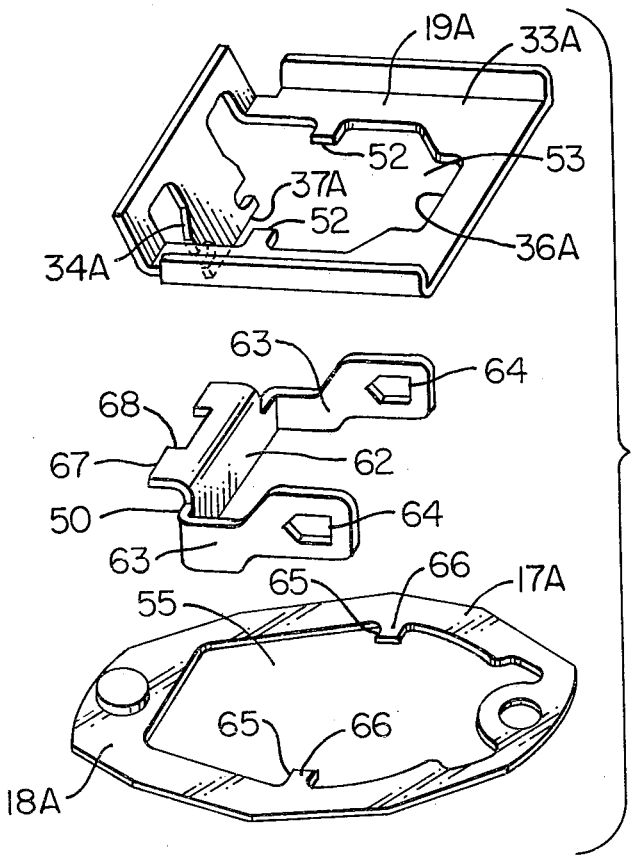
FIG. 6 is an exploded perspective view of the actuator spring member, toggle part and snap switch blade of the electrical switch construction of FIG. 5.

As illustrated in FIG. 6, the actuator spring member 19A has the central part thereof removed from the configuration illustrated in FIG. 4 so that the pivot edge 36A thereof still remains for pivotally mounting the spring actuator member 19A in the notch 32A of the L-shaped bracket 30A in the manner previously described while a pair of inwardly directed ears 52 of the actuator spring member 19A extend into an open area 53 that passes centrally through the leg 33A of the actuator spring member 19A.

In this manner, the surface 43A of the plunger 20A can abut against the tongues 52 of the actuator spring member 19A to control movement of the actuator spring member 19A in the same manner as the central abutment 42 on the actuator spring member 19 previously described.

However, the lower surface 43A of the actuator plunger 20A has an extension stem 54 projecting below the same and passing through the opening 53 of the actuator spring member 19A as well as through an opening 55 passing centrally through the switch blade 17A to engage against a spring retainer 56 as illustrated in FIG. 5, the spring retainer 56 being urged into contact with an enlarged head 57 of the stem extension 54 by the compression spring 51 having one end 58 thereof bearing against the spring retainer 56 and the other end 59 thereof bearing against another spring retainer 60 that engages against a threaded adjusting member 61 of the housing means 11A.

In this manner, the force of the compression spring 51 can be adjusted by the adjusting member 61 so that the force of the compression spring 51 will act on the plunger extension 54 to tend to urge the plunger 20A to the up illustrated in FIG. 5 for a purpose hereinafter described.

The toggle part 50 is best illustrated in FIG. 6 and comprises a cross member 62 having a pair of like legs 63 extending from the opposed ends thereof, each leg 63 having a fulcrum opening 64 passing therethrough to respectively receive an edge 65 of an inwardly directed ear 66 of the switch blade 17A that projects inwardly into central opening 55 thereof as illustrated.

The cross member 62 of the toggle part 50 has an upwardly and outwardly turned end 67 provided with a notch 68 therein so that the notch 68 can receive the free end 37A of the leg 34A of the actuator spring member 19A in the same manner that the tongue 26 of the switch blade 17 receives the end 37 of the leg 34 of the actuator spring member 19 previously described.

Thus, when the actuator member 19A is assembled to the L-shaped bracket 30A and to the toggle part 50, the leg 34A is forced outwardly relative to the leg 33A so that the actuator spring member 19A is placed under tension and thereby has a resultant spring force normally tending to rotate the actuator spring member 19A in a clockwise direction in FIG. 5 to hold the switch blade 17A with its contact portion 18A against the adjustable contact stop 15A as illustrated.

The operation of the electrical switch construction 10A will now be described.

With the electrical switch construction 10A disposed in the condition illustrated in FIG. 5, a force pushing downwardly on the plunger 20A that overcomes the rotational spring force of the actuator spring member 19A will cause the actuator spring member 19A to rotate in a counterclockwise direction and when the toggle part 50 moves over center relative to the switch blade 17A, the toggle part 50 through the stored spring energy of the actuator spring member 19A will snap the switch blade portion 18A upwardly to place the contact portion 18A into contact with the upper stop 16A in the manner previously described.

When the force on the plunger 20A is removed, not only will the return force of the spring 51 urge the plunger 20A upwardly, but also the normal clockwise rotational bias of the actuator spring member 19A will cause the same to move in a clockwise direction in FIG. 5 and when the toggle part 50 moves over the center relative to the switch blade 17A the toggle part 50, through the stored spring energy in the actuator spring member 19A, will snap the portion 18A of the switch blade 17A downwardly into contact with the contact stop 15A as illustrated in FIG. 4.

Therefore, it can be seen that the electrical switch construction 10A operates substantially in the same manner as the electrical switch construction 10 previously described.

However, it is found that by utilizing the toggle part 50 in place of the tongue 26 of the switch blade to operatively interconnect the actuator spring member 19A to the blade 17A, a maximizing of the differential stroke that the switch blade can handle at a safe stress level is provided, the toggling part 50 being inverted back in the same direction as the operating spring member 19A. This inversion puts the operating actuator spring member 19A in tension and allows for a larger stroke with less switch blade length. Thus, if the operating actuator spring member 19A is set up in a biased fashion, (versus bistable), this large differential travel is essential in minimizing mechanical drift. In this manner, not only is the percent drift reduced, but the tensile force of the operating actuator spring member is reduced and therefore the accompanying stresses.

It has been found that either the switch construction 10 or 10A previously described can readily fit into an envelope whose inside diameter measures only approximately 0.750 of an inch wherein the design requirements are for a single throw switch, although it can readily be seen that each of the switch constructions of this invention has the flexibility of being a single throw with both a normally open or normally closed contact arrangement, or a double throw switch as desired.

Figure 7:
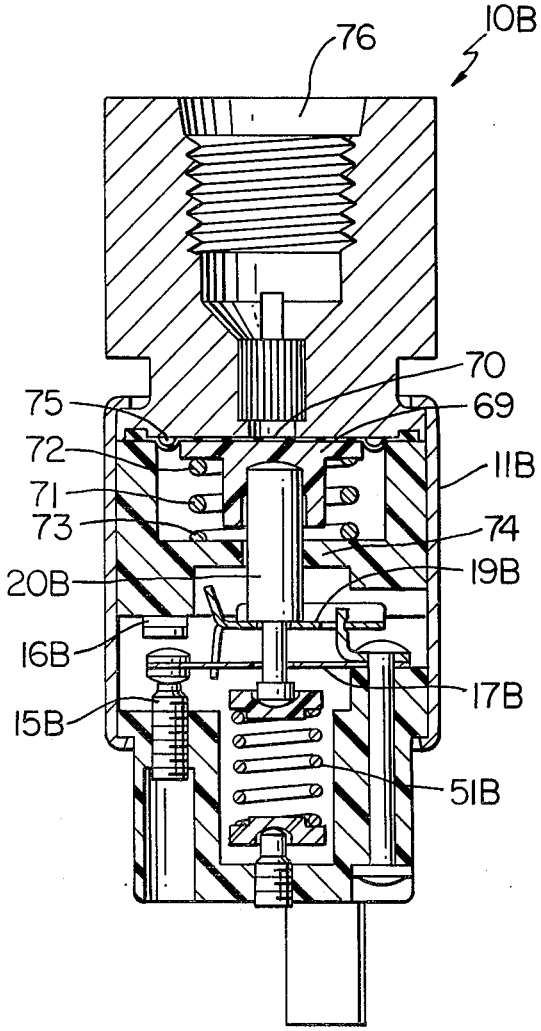
FIG. 7 is a view similar to FIG. 1 and illustrates another electrical switch construction of this invention.

Nevertheless, one such application is provided in FIG. 7 wherein the electrical switch construction of this invention is generally indicated by the reference numeral 10B and parts thereof that are similar to the switch constructions 10 and 10A previously described are indicated by the like reference numerals followed by the reference letter "B".

As illustrated in FIG. 7, the operating plunger 20B for the actuator spring member 19B engages against a spring retainer 69 that abuts against a flexible diaphragm 70 and is normally urged against the diaphragm 70 by a compression spring 71 having one opposed end 72 bearing against the spring retainer 69 and the other end 73 thereof bearing against an internal wall 74 of the housing means 11B.

In this manner, the flexible diaphragm 70 can form a chamber 75 with the housing means 11B that is interconnected to an inlet 76 so that pressure fluid or the like can be directed to the chamber 75 to act downwardly on the diaphragm 70 and, thus, on the actuator plunger 20B to cause movement of the plunger 20B downwardly in FIG. 7 and thereby cause the actuator spring member 19B to operate the switch blade 17B in the manner previously described for the electrical switch constructions 10 and 10A.

Therefore, whether the electrical switch construction 10B utilizes a toggle part 50 or a tongue 26 of switch blade 17B to operatively interconnect the actuator spring member 19B to the switch blade 17B, it can be seen that the electrical switch construction 10B will operate in the manner previously described in response to fluid pressure being directed to the chamber 75 to cause switching of the switch blade 17B for any desired purpose.

Therefore, it can be seen that this invention not only provides an improved electrical switch construction, but also this invention provides a method of making such an improved electrical switch construction, the resulting switch construction being adapted to be a miniature switch to be utilized in controls where extremely tight tolerances must be held and with the switch having a high degree of repeatibility, exhibiting minimum drift, able to handle D.C. loads of substantial current levels (6–8 amps D.C., for example), and have a range and differential travel that can be independently adjusted through a rather large calibration selection.

From the above, it can be seen that the electrical switch construction of this invention has many possible variations depending upon the application thereof. However, one feature that all the electrical switch constructions of this invention have in common is the general shape of the main switch blade and the use of an energy storage member previously described as the tensioned actuator spring member. It has been found that the combined lever ratio of the switch blade and of the spring member (ratio between contact movement and actuating plunger movement) can be approximately 2.3:1. This particular ratio was chosen to optimize the design as far as having minimum effect from contact erosion with maximum differential travel adjustment.

As previously described, the actuator spring member of this invention is so pivoted relative to the switch blade that the same is biased in a constant fashion about its pivot in a direction toward the actuator plunger. This feature is caused by having the actuator spring member's pivot elevated sufficiently from that of the switch blade. In this manner, as long as no force is exerted on the actuator plunger, the switch construction will always be in the condition illustrated in FIG. 1 or FIG. 5 and no additional return spring is actually needed. Thus, the effective switch rate is extremely low (approximately 5 lbs. per inch) and the slope of a typical activation curve has zero rate. If, however, an adjustment is needed or a different effective switch rate is desired, an additional return spring, such as spring 51, can be added to the bottom of the actuator plunger and the load on the actuator plunger is never felt by the critical switch members and therefore extremely high loads may be applied.

If it is desired to have a bistable switch for either additional differential stroke (loss motion) or a manual reset version, this can be accomplished with the switch construction of this invention by modifying the actuator spring member pivot. Either lowering of the actuator spring pivot or raising of the contact stops relative to the switch blade as illustrated in the drawings will cause the actuator spring member to have a varying direction of moment about its pivot. Correct pivot placement will create a sustainment of contact force on the normally closed contacts. If the particular application for the electrical switch construction of this invention calls for a switch that opens on increased stroke, as much as 30% of the electrical switch construction's contact force would be sustained at trip-point.

Another possible actuator spring member version would be a combination of the previously described two modifications. Once again, depending upon the height of the actuator spring member's pivot, the electrical switch construction could function such that throughout the differential travel and through a small amount of overtravel, the switch construction would be of the biased return fashion. However, if the actuation plunger is stroked an additional amount, the electrical switch construction could become bistable and would be required to be manually reset.

Therefore, it can be seen that the same switch blade and actuator spring member can provide three different types of electrical switch constructions. However, in each version, the contact force is either sustained or decreased in a fashion so as not to tease the contacts as fully described in the aforementioned co-pending patent application, Ser. No. 707,635. Approximately 50% of full contact force is maintained through approximately 75% of the differential travel when the switch construction functions in a biased return fashion. This results in a miniature switch with the capability of a wide range of applications.

While the forms and methods of this invention now preferred have been illustrated and described as required by the Patent Statute, it is to be understood that other forms and method steps can be utilized and still fall within the scope of the appended claims.

What is claimed is:

1. In an electrical switch construction comprising a housing means carrying a pair of spaced contact stops and a snap switch blade having a contact portion for being snapped between said stops when said blade is moved overcenter by an actuator spring member that is movable relative to said housing means by an actuator plunger, said actuator spring member having opposed ends respectively and operatively interconnected to said housing means and to said blade and being under tension between said ends thereof so as to have a resultant spring force normally tending to move said actuator member toward said plunger and thereby said blade toward one of said contact stops, the improvement wherein said actuator spring member comprises a one-piece substantially L-shaped leaf spring member separate from said blade and having two legs that respectively define said opposed ends thereof, one of said legs of said actuator spring member being pivotally mounted to said housing means to operatively interconnect said one leg to said housing means.

2. An electrical switch construction as set forth in claim 1 wherein said one leg of said actuator spring member is pivotally mounted to said housing means at a point that is intermediate said plunger and said blade and that is spaced from said blade.

3. An electrical switch construction as set forth in claim 2 wherein said blade has a tongue, the other of said legs of said actuator spring member being interconnected to said tongue to operatively interconnect said other leg to said blade.

4. An electrical switch construction as set forth in claim 2 and including a toggle part interconnected to said blade, the other of said legs of said actuator spring member being interconnected to said toggle part whereby said toggle part operatively interconnects said other leg of said actuator spring member to said blade.

5. An electrical switch construction as set forth in claim 2 wherein said housing means has a bracket member provided with a notch that defines said pivot point, said one leg having an edge received in said notch to pivotally mount said one leg to said housing means.

6. An electrical switch construction as set forth in claim 2 wherein said legs of said actuator spring member are disposed substantially transverse to each other.

7. An electrical switch construction as set forth in claim 2 wherein said actuator plunger is engageable with said one leg of said actuator spring member.

* * * * *